US010286289B2

(12) United States Patent
Owen et al.

(10) Patent No.: US 10,286,289 B2
(45) Date of Patent: May 14, 2019

(54) CONNECTABLE SKI POLES

(71) Applicant: Kent Owen, Deakin, ACT (AU)

(72) Inventors: Kent Owen, Deakin (AU); Marc Philipp Veenendaal, Cartingbah (AU)

(73) Assignee: Kent Owen, Deakin, ACT (AU)

( * ) Notice: Subject to any disclaimer, the term of this patent is extended or adjusted under 35 U.S.C. 154(b) by 0 days.

(21) Appl. No.: 15/756,163

(22) PCT Filed: Sep. 1, 2016

(86) PCT No.: PCT/AU2016/000302

§ 371 (c)(1),
(2) Date: Feb. 28, 2018

(87) PCT Pub. No.: WO2017/035561

PCT Pub. Date: Mar. 9, 2017

(65) Prior Publication Data

US 2018/0256966 A1 Sep. 13, 2018

(30) Foreign Application Priority Data

Sep. 3, 2015 (AU) ..... 2015903601
Jan. 13, 2016 (AU) ..... 2016900091

(51) Int. Cl.
*A63C 11/00* (2006.01)
*A63C 11/22* (2006.01)
*A63C 11/24* (2006.01)

(52) U.S. Cl.
CPC ..... *A63C 11/222* (2013.01); *A63C 11/24* (2013.01)

(58) Field of Classification Search
CPC ..... A63C 11/222; A63C 11/24; A63C 11/22; A63C 11/227; A63C 11/228
See application file for complete search history.

(56) References Cited

U.S. PATENT DOCUMENTS 3,001,483 A * 9/1961 Gmeiner ..... A63C 11/22 104/173.2
3,576,332 A * 4/1971 Bruckl ..... A63C 11/22 280/820
3,687,472 A * 8/1972 Struble, Jr. ..... A63C 5/02 180/181
3,866,931 A 2/1975 Marker
(Continued)

FOREIGN PATENT DOCUMENTS

DE 605168 11/1934
RU 2026106 1/1995

*Primary Examiner* — James M Dolak
(74) *Attorney, Agent, or Firm* — Welsh Flaxman & Gitler LLC

(57) ABSTRACT

A pair of first and second ski poles that can be connected to each other. The first ski pole has a first shaft with a first hand-grip at an upper end thereof and a first basket near the lower end thereof. The second ski pole has a second shaft with a second hand-grip at an upper end thereof and a second basket near the lower end thereof. The first and second ski poles can be interconnected by engagement of the first and second baskets to each other and engagement of the first and second hand-grips to each other. The first hand grip is mounted to the first shaft via a spring for limited axial movement relative thereto, and engagement of the first and second hand-grips is maintained by a biased force provided by the spring.

19 Claims, 16 Drawing Sheets

(56) References Cited

U.S. PATENT DOCUMENTS

| | | | | | |
|---|---|---|---|---|---|
| 4,175,683 | A * | 11/1979 | Shields | A63C 11/22 | 280/814 |
| 4,244,602 | A | 1/1981 | Allsop et al. | | |
| 4,354,585 | A * | 10/1982 | Ritter | F16D 41/088 | 192/45.006 |
| 4,358,138 | A * | 11/1982 | Laughlin | A63C 11/22 | 135/66 |
| 4,361,347 | A * | 11/1982 | MacIntyre | A63C 11/025 | 224/917.5 |
| 4,861,072 | A * | 8/1989 | Humphrey | A63C 11/025 | 280/814 |
| 6,898,824 | B2 * | 5/2005 | Zaltron | A63C 11/221 | 135/66 |
| 7,119,304 | B2 | 10/2006 | Meyers | | |
| 8,235,423 | B2 * | 8/2012 | Starry | A63C 11/025 | 280/814 |
| 8,235,424 | B2 * | 8/2012 | Garcia | A63C 11/228 | 280/816 |
| 8,973,946 | B2 * | 3/2015 | Carr | A63C 11/222 | 280/816 |
| 9,101,818 | B2 * | 8/2015 | Carr | A63C 11/222 | |
| 2001/0011817 | A1 | 8/2001 | Zaltron | | |

* cited by examiner

CONNECTABLE SKI POLES

TECHNICAL FIELD

The present invention relates to ski poles. In particular the invention is described with reference to a pair of ski poles that can be connected to each other.

BACKGROUND

Ski poles, sometimes referred to as stocks, are used by skiers for balance and propulsion. A modern ski pole typically has a shaft made of aluminium or carbon fibre, a grip (handle) attached to the upper part of the shaft, and a basket near the bottom end of the shaft to stop the pole from sinking into deep snow. The grips of most ski poles are provided with straps that are slipped over the wrist to improve the skiers hold on the grip, and to prevent the loss of the pole in the event of a fall.

In ski resorts, chair lifts are the most common way for skiers to ascend the mountain to the top of the ski trails. When queuing to get on a chair lift, a skier is expected to take the pole straps off their wrists, and not to slip them back on until after they have got off the chair lift. When getting seated into a chair lift, the skier typically holds both ski poles in one hand whilst using the other hand to bring down the safety bar. Should the skier not securely hold onto the ski poles it is easy to drop them, which may pose a hazard and the inconvenience involved in retrieving them.

There is prior art directed to connecting ski poles so that they can be carried and stowed both on and off chair lifts. Some of these proposals as described in DE221873 (Westerhoff), U.S. Pat. No. 4,234,202 (Loffelholz) and FIG. 6 of DE10325081 (Baumgartner) utilize magnets on the grips to interconnect them. One of the problems with such devices is that when the grips are close to each other, the magnets will cause attraction and connection even when the skier doesn't want them connected. Furthermore the magnets may be attracted to other ferromagnetic materials.

DE10325081 also describes other embodiments which involve non-magnetic locking, with the locking parts on or below the lower part of the grips. In these arrangements it is difficult to quickly connect and disconnect them, and some are more suited for long term connection rather than a quick connect of the ski poles when intending to get on a chair lift. One of the reasons they are difficult to quick connect, is that ski poles whilst being held by a user must be placed one in front of the other, as the locking parts are in the respective aft and fore sections of the lower part of the grips, making them difficult to quickly align for connection. Some of these embodiments also significantly alter the configuration of the lower part of the hand grips and have large protruding locking parts, which are not desirable as they can inadvertently catch or snag onto to clothing, or easily become damaged.

One arrangement used for detachably interconnecting ski poles mechanically is disclosed in U.S. Pat. No. 3,866,931 (Marker). It relies on snowheads (baskets) near the tip end of the poles, each of which have a first lower hook (a first pair of connecting elements) that can engage with each other, and each handle has a second upper hook (a second pair of connecting elements). In order to allow for the interconnection, the tubular shafts must be elastically deformable in length to at least an extent of the hooks. In order to connect, the lower hooks on the snowheads must engage with each other and the ski pole having the lower upward opening hook must be pulled upwards so that its tubular shaft extends elastically to allow the upper hook on the same ski pole to clear and then engage with the upper hook on the other ski pole. The primary disadvantage is that the hooks are at the lower end of the handle, which means that their location and the extent to which they protrude, may result in them catching or snagging onto to clothing/zippers and the like, or easily become damaged. This is because a user's hand grasps the ski pole handle above the hooks, and in use of the poles it is easy for the exposed protruding hooks to snag onto the user's clothing and the like.

Another arrangement disclosed in U.S. Pat. No. 3,687,472 (Struble, Jr) show ski poles adapted to be mechanically connected together to hold a pair of skis. The ski poles have handles as shown in FIG. 5 that utilise a plurality of deep groove and rib formations formed in the front of each handle, which are adapted to interlock together. The ribs are enlarged at their outermost ends to provide a snapping action. However a number of disadvantages are associated with this arrangement. Firstly, the front of one handle requires alignment with front of the other handle such that ribs of one handle may be snapped into connection with the grooves of the other handle. This alignment must be accurately done to ensure that all the ribs on one handle align with the grooves on the other, and may not be carried out quickly otherwise there is a risk of incorrect connection or damage to the ribs. Secondly, the nature of the ribs and grooves means that debris, snow or ice can be embedded in the grooves (ie between the ribs) and trapped there by the enlarged outermost ends of the ribs, making it both difficult to remove such debris and/or snow/ice and to interconnect the handles. Furthermore, the handles are provided with straps and snap fasteners that are used to bind the handles together once the ribs and grooves have been connected. Both the abovementioned disadvantages make such interconnection of handles suited to stowing and transporting of poles and skis to and from the skiing area, rather than for a quick connection of ski poles on the ski slopes in order to ride a chair lift, or to have a short break from skiing.

All of these abovementioned prior art arrangements suffer from the various disadvantages discussed above, and are therefore not suitable for use on the ski fields during use of ski poles for quick and secure connection and disconnection. Despite some of the prior art mechanical locking arrangements being more than forty years old, they have not been commercialised.

The present invention seeks to overcome at least one of the disadvantages of the prior art.

SUMMARY OF INVENTION

According to a first aspect the present invention consists in a pair of first and second ski poles connectable to each other, said first ski pole having a first shaft with a first hand-grip at an upper end thereof and a first basket near the lower end thereof, said second ski pole having a second shaft with a second hand-grip at an upper end thereof and a second basket near the lower end thereof, said first hand-grip having a locking device thereon for connection to a counter locking device on said second hand-grip, said first hand-grip and second hand-grip each has a pommel at its upper end, and characterised in that said locking part and counter locking part are formed integrally with the respective pommels each at a location below the top of pommel, and said first hand-grip is biasedly mounted to said first shaft by a first spring that allows limited axial movement of said hand-grip relative to said first shaft, and in use for connection of said first and second poles said first and second baskets engage with each other, and said locking part of said first hand-grip is held in biased engagement with said counter locking part of said second hand grip.

Preferably said first hand-grip is mechanically restrained to prevent it being detached from said first shaft by the bias force provide by said first spring.

Preferably said locking device of said first hand-grip is a projecting locking part, and said counter locking device is a counter locking part for receiving said projecting locking part.

Preferably a ramp is disposed on said projecting locking part, and a lip is associated with said counter locking part, and said ramp and said lip when brought into engagement with each other to assist said projecting locking part into engagement with said counter locking part.

Preferably said second hand-grip is biasedly mounted to said second shaft by a second spring that allows limited axial movement of said second hand-grip relative to said second shaft.

Preferably said first basket of said first pole has male projections engagable with apertures disposed on said second basket.

Preferably said first basket and said second basket are identical, and said first basket and second basket each has a plurality of engagement units, to allow engagement therebetween.

A pair of first and second ski poles as claimed in claim 10, wherein each engagement unit includes a male projection and an aperture.

Preferably each of said first hand-grip and second hand-grip are of two piece construction mounted to its respective shaft via mounting fixture engaging the shaft.

Preferably each of said first hand-grip and second hand-grip has a pommel at its upper end, and said locking part and counter locking parts are formed integrally with the respective pommels.

According to a second aspect the present invention consists in a pair of first and second ski poles said first ski pole having a first shaft with a first hand-grip at an upper end thereof and a first basket near the lower end, said second ski pole having a second shaft with a second hand-grip at an upper end thereof and a second basket near the lower end, wherein said first and second ski poles can be interconnected by engagement of said first and second baskets to each other and engagement of said first and second hand-grips to each other, said first hand-grip and second hand-grip each has a pommel at its upper end, and characterised in that a locking part and a counter locking part are formed integrally with the respective pommels each at a location below the top of pommel, and said first hand-grip is biasedly mounted to said first shaft by a first spring that allows limited axial movement of said hand-grip relative to said first shaft, and said engagement of said first and second hand-grips is maintained by a biased force provided by said first spring.

Preferably said first hand-grip is mechanically restrained to prevent it being detached from said first shaft by the bias force provide by said first spring.

Preferably a ramp is disposed on said projecting locking part, and a lip is associated with said counter locking part, and said ramp and said lip when brought into engagement with each other to assist said projecting locking part into engagement with said counter locking part.

Preferably said second hand grip is mounted to said second shaft via a second spring for limited axial movement relative thereto.

Preferably each of said first hand-grip and second hand-grip are of two piece construction mounted to its respective shaft via mounting fixture engaging the shaft.

According to a third aspect the present invention consists in a ski pole comprising a shaft with a hand-grip at an upper end thereof, and a basket near a lower end, characterised in that said hand grip is biasedly mounted to said shaft via a spring for limited axial movement relative to said shaft, and said hand-grip has a first pommel at its upper end and a locking part integrally formed with and projecting from below the top of said pommel for connecting to a female counter locking part integrally formed on a second pommel of another associated ski pole.

Preferably a ramp is disposed on said projecting locking part, and a lip is associated with said counter locking part on said associated ski pole, and said ramp and said lip when brought into engagement with each other to assist said projecting locking part into engagement with said counter locking part.

Preferably said first hand-grip is of a two piece construction mounted to said shaft via a mounting fixture.

Preferably said spring is mounted on a lug on said mounting fixture.

Preferably each piece of said hand-grip has a post slidably engagable with a respective keyway pocket in said mounting fixture.

DESCRIPTION OF PREFERRED EMBODIMENTS

Figure 1:
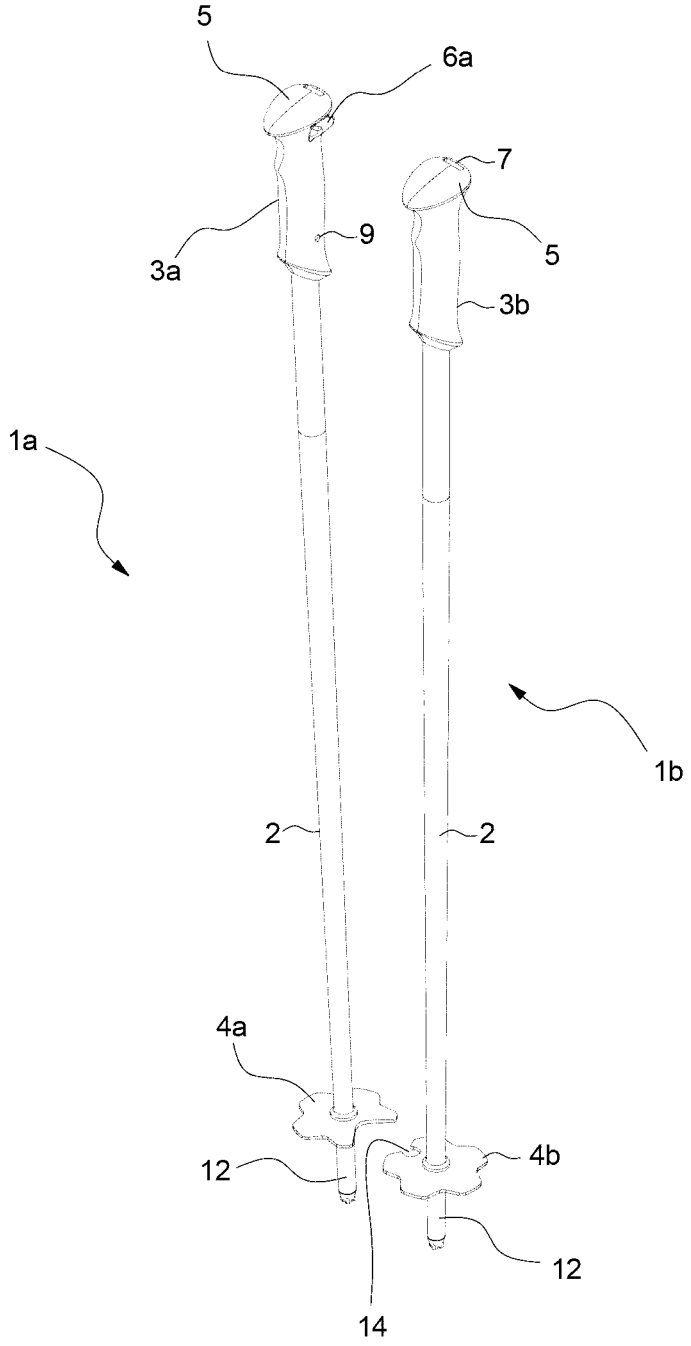
FIG. 1 is a perspective view of a pair of ski poles in accordance with a first embodiment of the present invention in spaced apart configuration.
Figure 2:
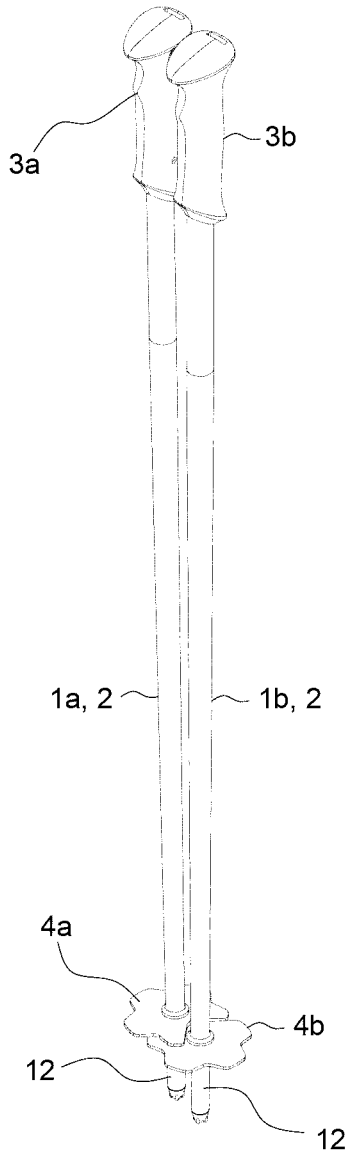
FIG. 2 is a perspective view of the pair of ski poles of FIG. 1 in a connected configuration.
Figure 3:
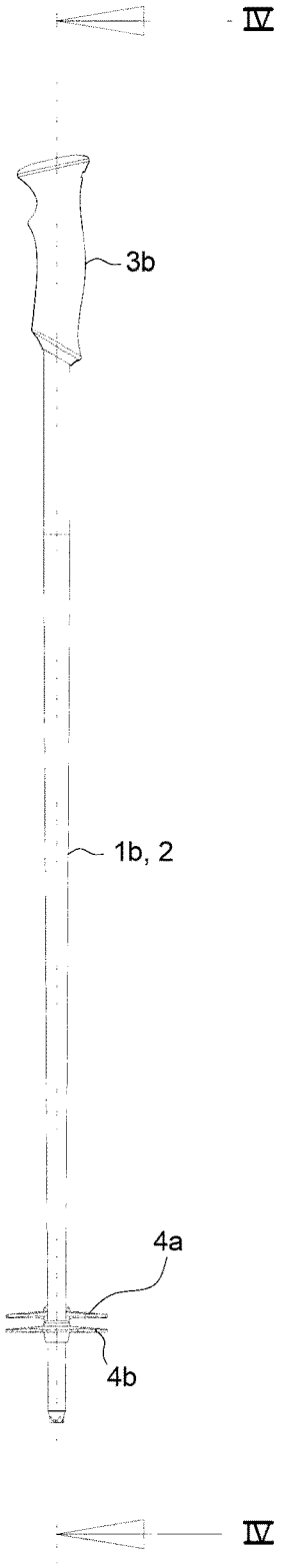
FIG. 3 is a side view of the pair of ski poles shown in FIG. 2 in the connected configuration.
Figure 4:
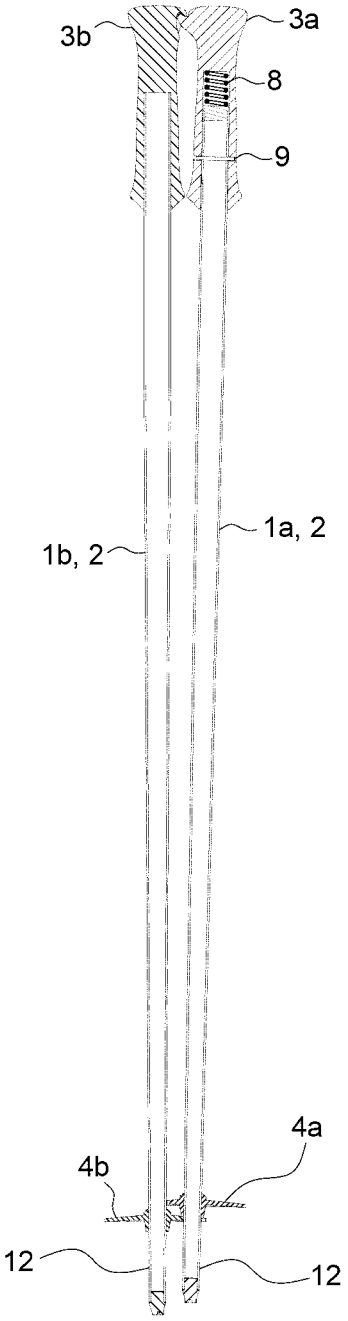
FIG. 4 is a cross-sectional view of the pair of ski poles through IV-IV shown in FIG. 3 in the connected configuration.

FIGS. 1 to 7 depict a first embodiment of a pair of first and second ski poles 1*a*, 1*b* capable of being interconnected to each other.

First ski pole 1*a* has a shaft 2 with a first hand-grip 3*a* at an upper end thereof, and a first basket 4*a* near the lower tip end 12. Second ski pole 1*b* has a shaft 2 with a second hand-grip 3*b* at an upper end thereof, and a second basket 4*b* near the lower tip end 12.

Both first and second hand-grips 3*a*,3*b* are preferably made of plastic, and each have a pommel 5 at their upper end. An aperture 7 is provided in each pommel 5 for receiving a strap (not shown).

On first hand-grip 3*a* below the top of its respective pommel 5 and on one side thereof, is a substantially upward projecting male locking part 6*a*. On second hand-grip 3*b* below the top of its its respective pommel 5 and on one side thereof, is a substantially downwardly female/concave (or counter) locking part 6*b* adapted to receive locking part 6*a* of first hand-grip 3*a*.

First hand-grip 3*a* is biasedly mounted to shaft 2 of pole 1*a* by means of coil spring 8, and is capable of limited axial movement relative to shaft 2. A pin 9 engaging shaft 2 restrains hand grip 3*a* from being detached from shaft 2 under the influence of spring 8. The biased force of spring 8 to extend urges hand-grip 3*a* way from tip end 12. Compression of spring 8 allows hand-grip 3*a* to be urged axially a limited short distance, say of less than 5 mm, towards the opposite tip end 12 of shaft 2.

Baskets 4*a*, 4*b* are preferably made of plastic. Basket 4*b* of pole 1*b* has a slot 14 capable of having tip end 12 of pole 1*a* engage therewith.

Figure 5:
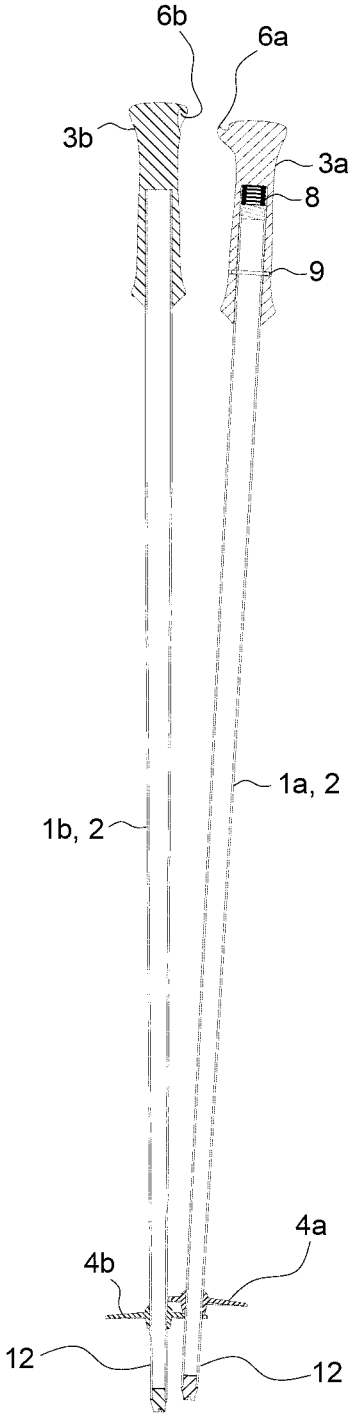
FIG. 5 is a cross-sectional view of the pair of ski poles with the baskets engaged and the spring compressed.
Figure 7:
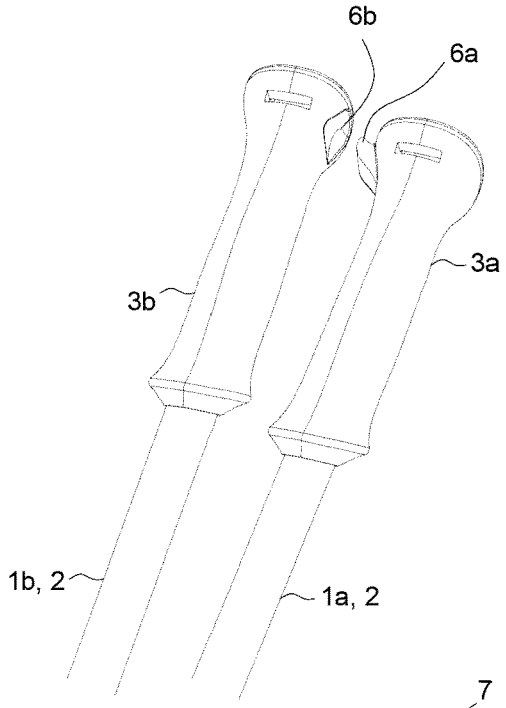
FIG. 7 is an enlarged lower rear perspective view of the hand-grips of the ski poles shown in FIG. 1.
Figure 6:
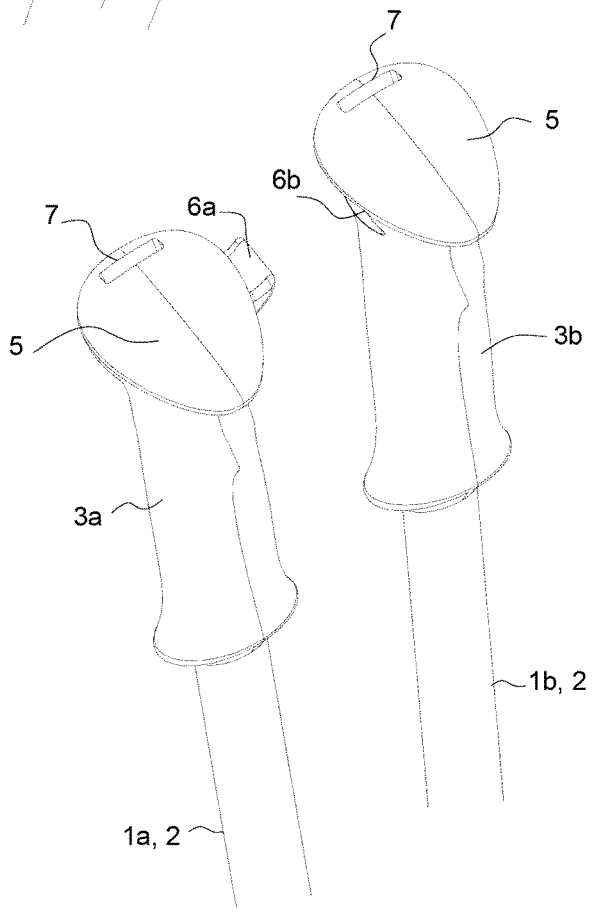
FIG. 6 is an enlarged upper front perspective view of the hand-grips of the ski poles shown in FIG. 1.

In use, when a user (not shown) wants to connect ski poles 1*a*,1*b* to each other he engages tip end 12 of pole 1*a* in slot 14 of basket 4*b*, with basket 4*a* located above basket 4*b* as shown in FIG. 5, and brings poles 1*a*,1*b* in close proximity to each other. He then urges hand-grip 3*a* to axially compress spring 8 and holds it there, while bringing male locking part 6*a* into alignment with female locking part 6*b* on hand grip 3*b*. Release of hand grip 3*a* by the user causes spring 8 to axially extend urging male locking part 6*a* of hand grip 3*a* into engagement with female locking part 6*b*. As baskets 4*a*, 4*b* are inter-engaged, male locking part 6*a* of hand-grip 3*a* will remain in engagement with female locking part 6*b* of hand-grip 3*b*, as a result of the biased force provided by spring 8, thereby connecting poles 1*a*,1*b*.

To release (or disconnect) poles 1*a*,1*b* from one another, the user again urges hand grip 3*a* to axially compress spring 8, so that male locking part 6*a* can be removed from female locking part 6*b*, and then removes tip end 12 of pole 1*a* from slot 14 of basket 4*b*.

Figure 8C:
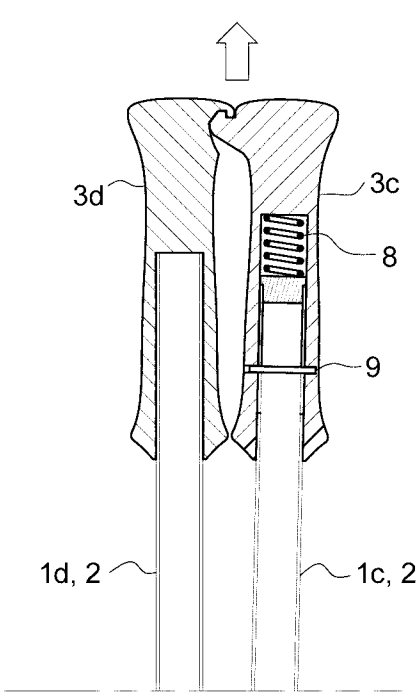
FIGS. 8*a*, 8*b* and 8*c* are cross-sectional schematics of the hand grips of a pair of ski poles in accordance with a second embodiment of the present invention apart, as they are being brought together and in engagement.
Figure 8B:
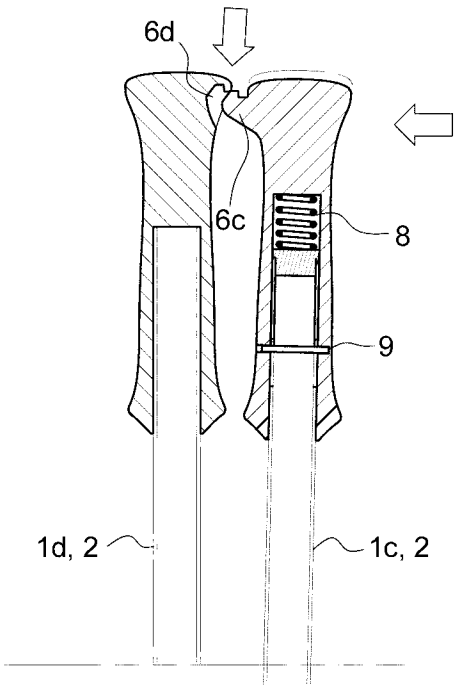
Figure 8A:
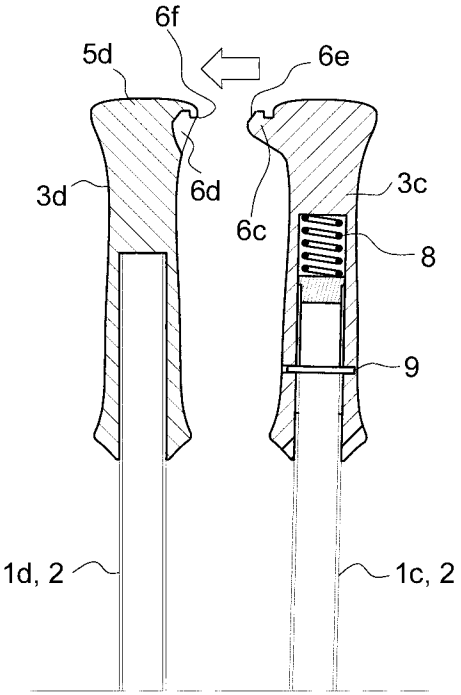
Figure 9:
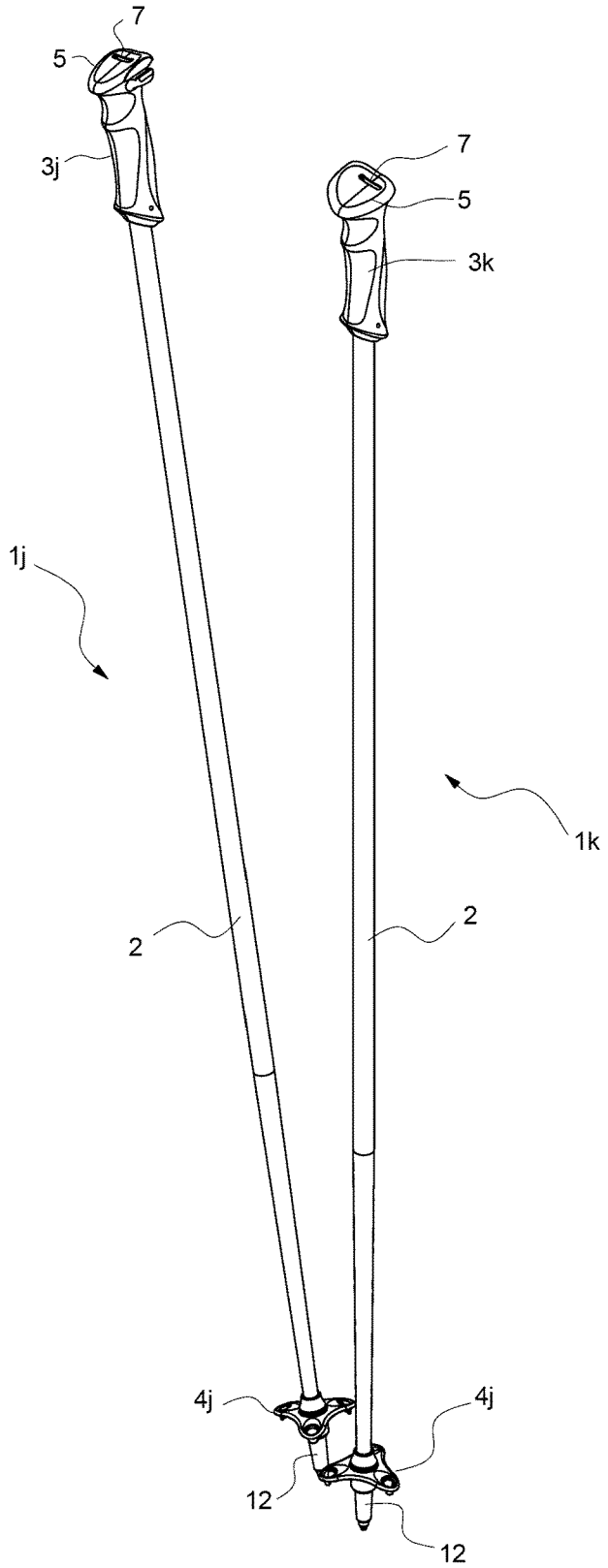
FIG. 9 is a perspective view of a pair of ski poles in accordance with a third embodiment of the present invention in spaced apart configuration.
Figure 10:
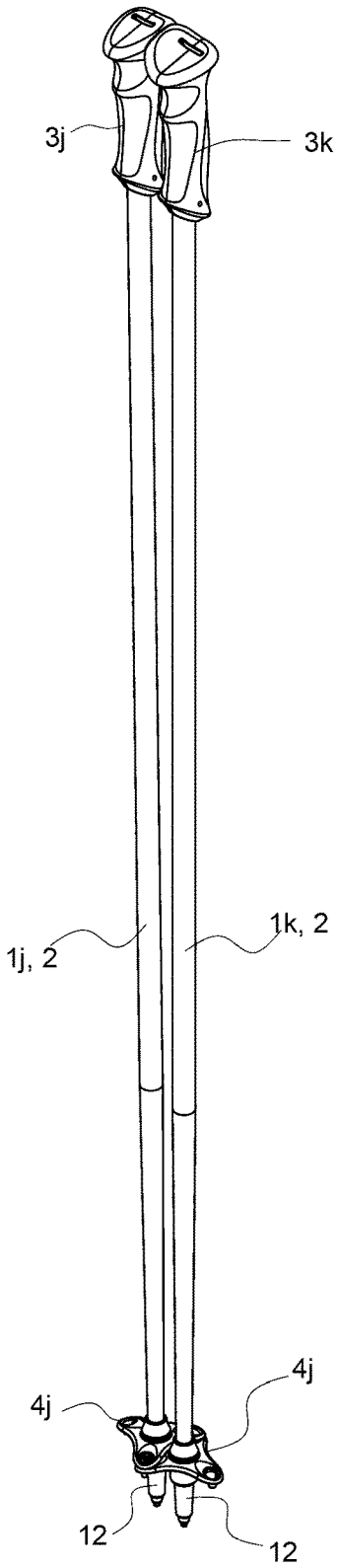
FIG. 10 is a perspective view of the pair of ski poles of FIG. 9 in a connected configuration.
Figure 11:
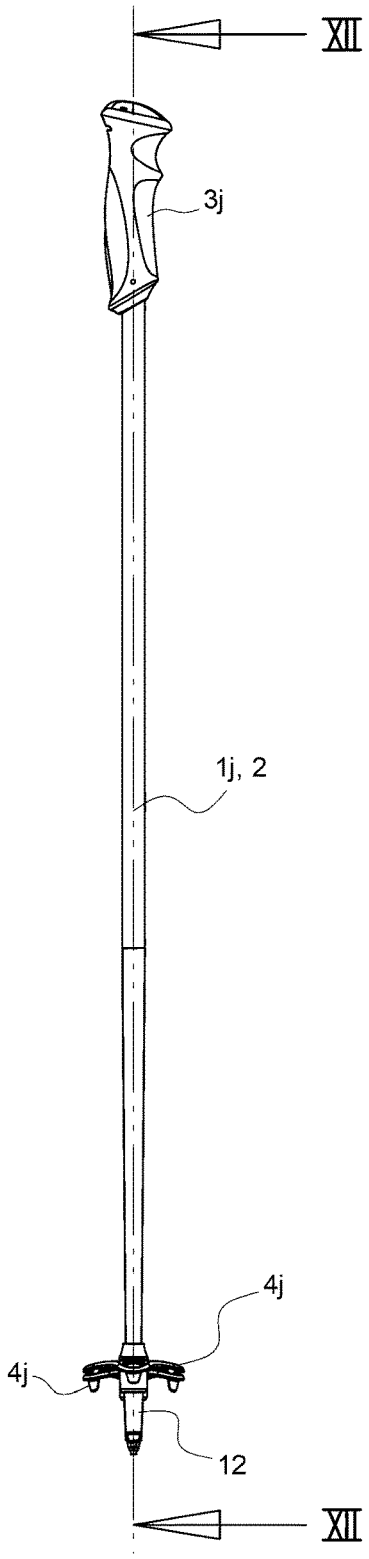
FIG. 11 is a side view of the pair of ski poles shown in FIG. 10 in the connected configuration.
Figure 12:
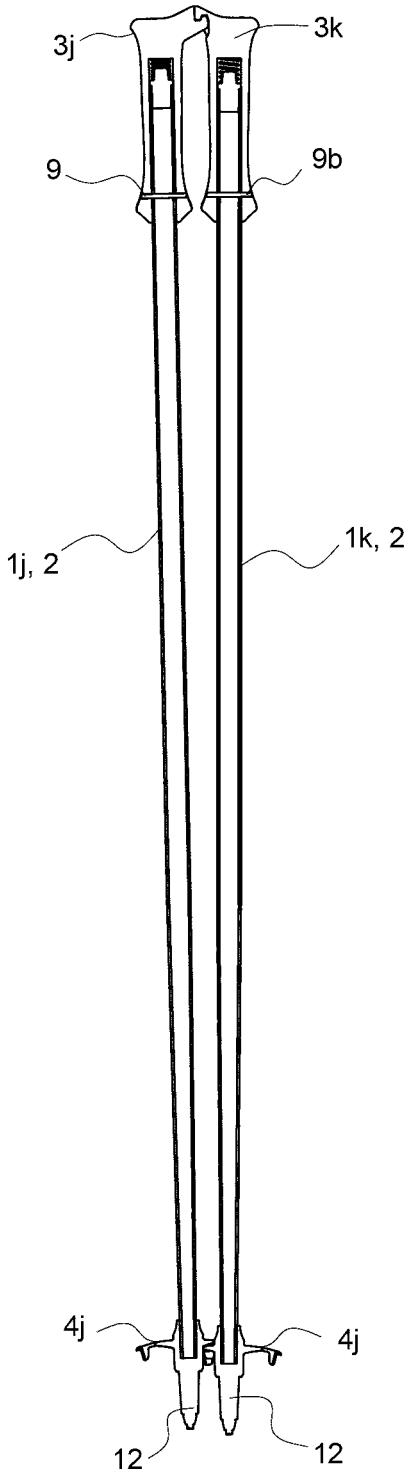
FIG. 12 is a cross-sectional view of the pair of ski poles through XII-XII shown in FIG. 11 in the connected configuration.
Figure 13:
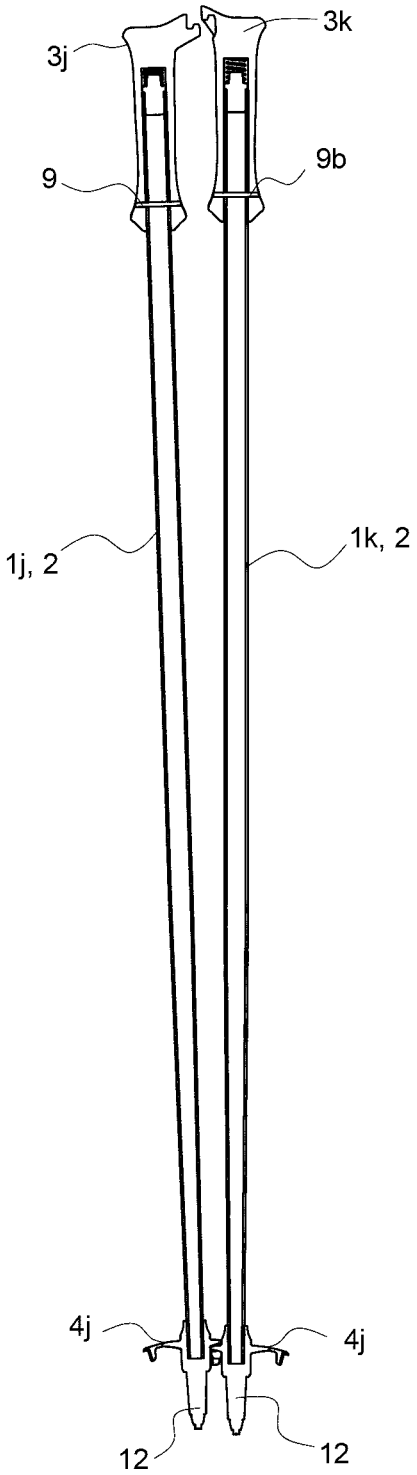
FIG. 13 is a cross-sectional view of the pair of ski poles with the baskets engaged and a spring compressed.

FIGS. 8*a*, 8*b* and 8*c* depict hand grips 3*c* and 3*d* of a pair of ski poles 1*c* and 1*d* in a second embodiment. Ski poles 1*c* and 1*d* have shafts 2, a coil spring 8, pin 9 and baskets and tip ends (not shown) similar to those components on poles 1*a* and 1*b*. However, in this embodiment the male locking part 6*c* and female locking part 6*d* differ in shape to the male and female locking parts 6*a*, 6*b* of the first embodiment.

Male locking part 6*a* has a ramp 6*e* disposed thereon, whilst female locking part has a lip 6*f* associated therewith at pommel 5*d* of grip 3*d*. Ramp 6*e* and lip 6*f* assist in the "quick connect" of male locking part 6*c* and female locking part 6*d*.

FIG. 8*a* depicts the hand grips 3*c* and 3*d* spaced apart as they are being brought together. With the tip end of ski pole 1*c* engaged with the basket of pole 1*d*, hand grip 3*c* can be brought towards hand grip 3*d*, as shown in FIG. 8*b*. As ramp 6*e* strikes lip 6*e*, hang grip 3*c* would be urged downwardly against the bias of spring 8 a short distance, until male locking member 6*c* is able to be urged under the influence of spring 8 into engagement with the concave portion of female locking part 6*d* as depicted in FIG. 8*c*. To release (or disconnect) poles 1*c*,1*d* from one another, the user urges hand grip 3*c* to axially compress spring 8, so that male locking part 6*c* can be removed from female locking part 6*d*, in a similar manner to the first embodiment. It should be noted that the male and female locking parts 6*a*, 6*b* (and 6*c*,6*d*) which are located in the respective upper parts of hand-grips 3*a*,3*b* (3*c*,3*d*) below the top of pommels 5, and integral with pommel 5, do not need to be large in size and the biased nature of the spring loaded hand-grip 3*a*(3*c*) assists in the quick location of male locking part 6*a*(6*c*) into female locking part 6*b*(6*c*). As the locking parts 6*a*, 6*b* (and 6*c*,6*d*) are small and located just below the top of pommels 5, they do not pose a risk of snagging or catching on to clothing and the like, or getting damaged, as is the case with the prior art. This because in use, when a user's gloved hand (not shown) grasps the handle, small sized locking parts 6*a*. 6*b* (and 6*c*,6*d*) do not pose a risk of snagging or catching on other clothing. Also in the rare event that debris and/or snow/ice enter the female locking parts 6*b*,6*d*, then the user can quickly tap the hand grips of the ski poles together, causing the debris and/or snow/ice to readily fall out. Furthermore the male and female locking parts 6*a*,6*b* (6*c*,6*d*) are on the sides of the respective hand grips 3*a*,3*b* (3*c*,3*d*), rather than the aft and fore ends as in the prior art DE10325081, making it easy for the user to bring the hand grips 3*a*,3*b* (3*c*,3*d*) together and engage the locking parts 6*a*,6*b* (6*c*,6*d*).

The limited axial movement of hand-grip 3*a* or 3*c* is so small that this movement is negligible and not noticeable to the user when ski pole 1*a* or 1*c* is being used conventionally for balance and propulsion.

FIGS. 9 to 20*c* depict a third embodiment of a pair of first and second ski poles 1*j*,1*k* capable of being interconnected to each other.

In a similar fashion to the poles of the first embodiment, first ski pole 1*j* has a shaft 2 with a first hand-grip 3*j* at an upper end thereof, and a basket 4*j* near the lower tip end 12.

Second ski pole 1*k* has a shaft 2 with a second hand-grip 3*k* at an upper end thereof, and a second basket 4*j* near the lower tip end 12.

Both first and second hand-grips 3*j*,3*k* like those of the first embodiment are preferably made of plastic, and each have a pommel 5 at their upper end. An aperture 7 is provided in each pommel 5 for receiving a strap (not shown).

On first hand-grip 3*j* below its respective pommel 5 and on one side thereof, is a substantially upward projecting male locking part 6*j*. On second hand-grip 3*k* below its respective pommel 5 and on one side thereof, is a substantially downwardly female/concave (or counter) locking part 6*k* adapted to receive locking part 6*j* of first hand-grip 3*j*.

First hand-grip 3*j* is biasedly mounted to shaft 2 of pole 1*j* by means of coil spring 8, and is capable of limited axial movement relative to shaft 2. A pin 9 engaging shaft 2 restrains hand grip 3*j* from being detached from shaft 2 under the influence of spring 8. The biased force of spring 8 to extend urges hand-grip 3*j* way from tip end 12. Compression of spring 8 allows hand-grip 3*j* to be urged axially a limited short distance, say of less than 5 mm, towards the opposite tip end 12 of shaft 2.

Figure 16:
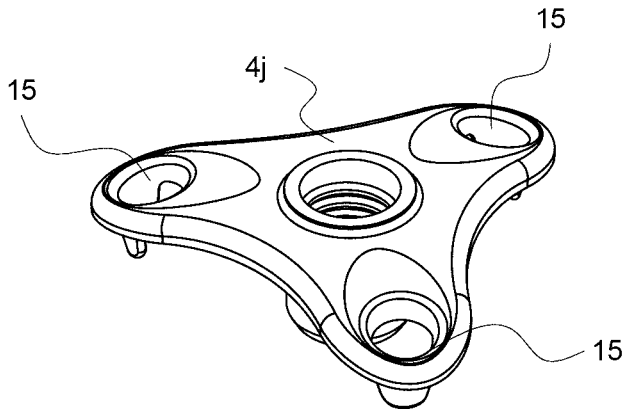
FIG. 16 depicts an upper enlarged perspective view of the basket shown alone, of the type used in the pair of ski poles shown in FIG. 9.
Figure 17:
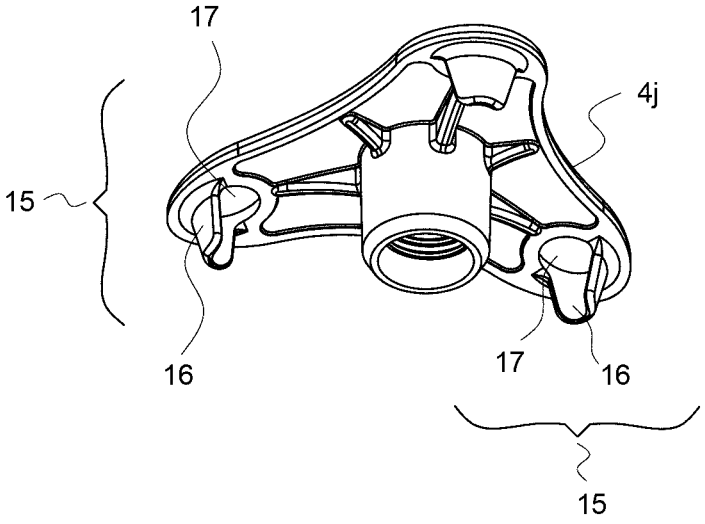
FIG. 17 depicts a lower enlarged perspective view of the basket of FIG. 16.
Figure 18:
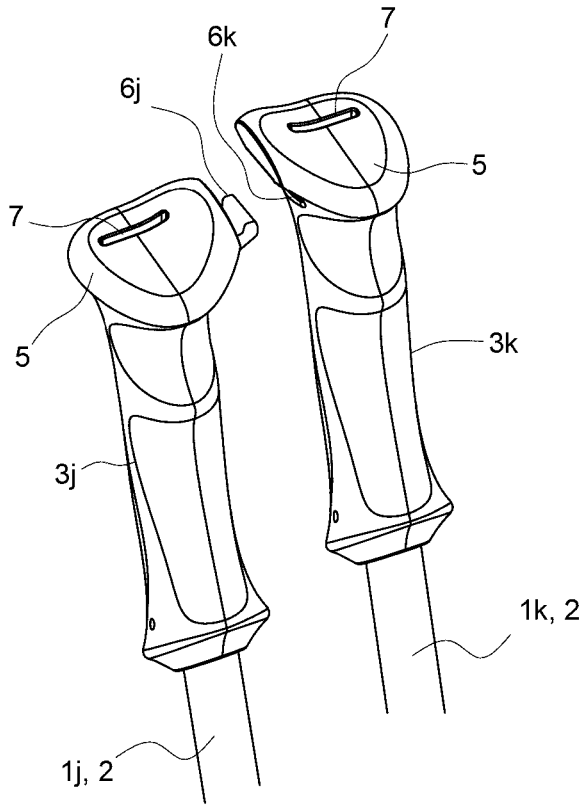
FIG. 18 is an enlarged upper front perspective view of the hand-grips of the ski poles shown in FIG. 9.
Figure 19:
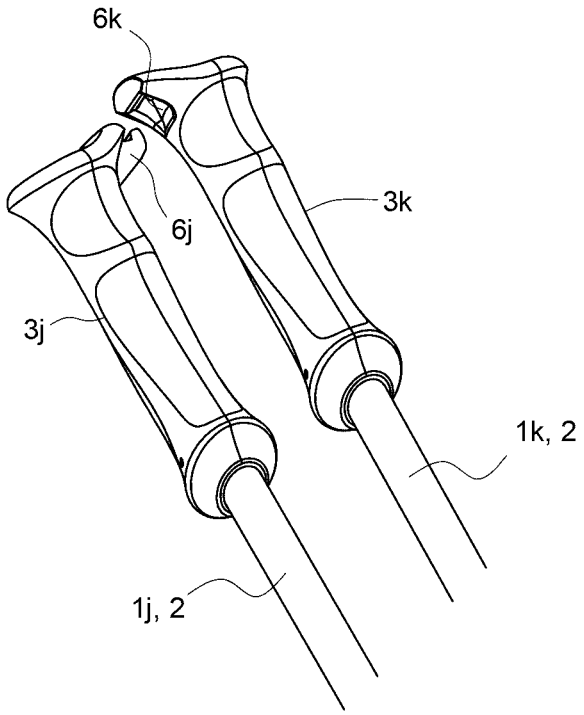
FIG. 19 is an enlarged lower rear perspective view of the hand-grips of the ski poles shown in FIG. 9.

Baskets 4*j* used on first and second ski poles 1*j*,1*k* are identical to each other, and are preferably made of plastic. Each basket 4*j* has a three engagement units 15. Each engagement unit 15 is made up of a prong (male projection) 16 paired with an aperture 17, as best seen in FIGS. 16 and 17. In order to operably connect baskets 4*j* to one another, two prongs 16 on one basket 4*j* nestably engage with respective apertures 17 on the other basket 4*j*.

Figure 14:
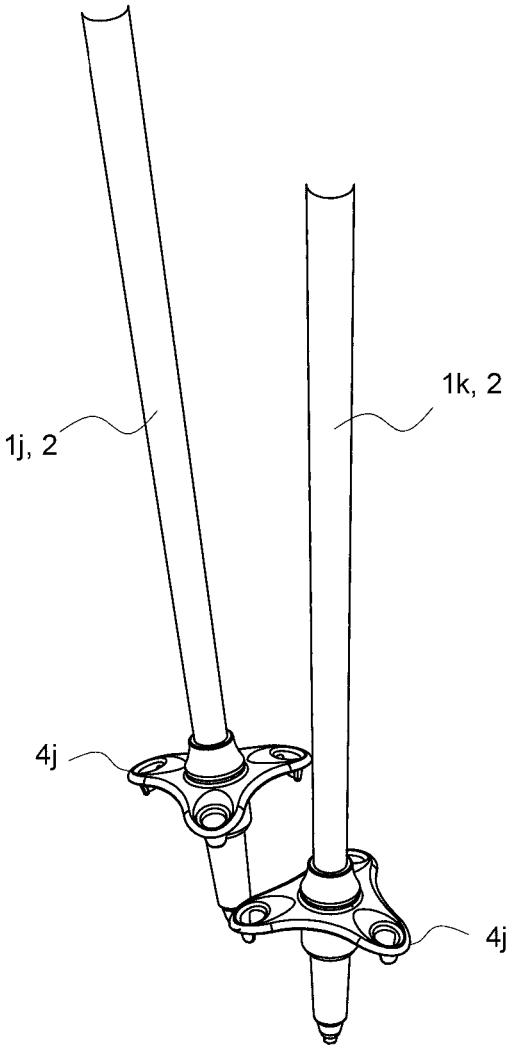
FIG. 14 is a partial enlarged perspective view of the baskets of the pair of ski poles of FIG. 9, in spaced apart configuration.
Figure 15:
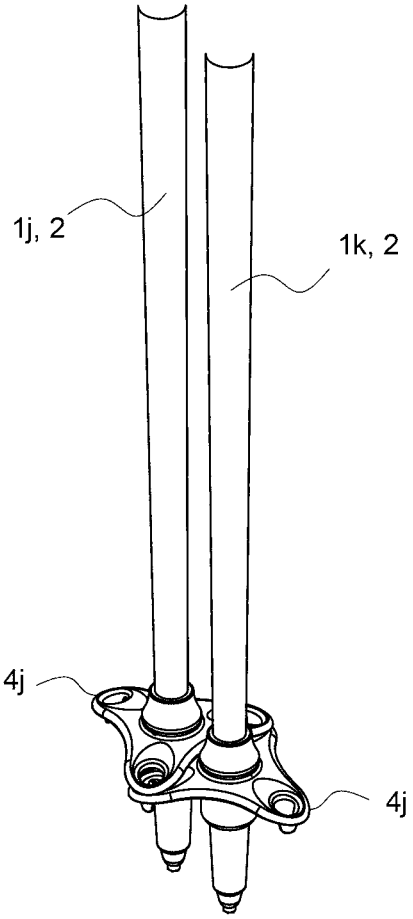
FIG. 15 is a partial enlarged perspective view of the baskets of the pair of ski poles of FIG. 10, in connected configuration.

In use, when a user (not shown) wants to connect ski poles 1*j*,1*k* to each other he nestably engages basket 4*j* of pole 1*k* with the basket 4*j* of pole 1*j*, as best seen in FIGS. 14 and 15. He then urges hand-grip 3*j* to axially compress spring 8 and holds it there, while bringing male locking part 6*j* into alignment with female locking part 6*k* on hand grip 3*k*. Release of hand grip 3*j* by the user causes spring 8 to axially extend urging male locking part 6*j* of hand grip 3*j* into engagement with female locking part 6*k* on hand grip 3*j*. As baskets 4*j* are inter-engaged, male locking part 6*j* of hand-grip 3*j* will remain in engagement with female locking part 6*k* of hand-grip 3*k*, as a result of the biased force provided by spring 8, thereby connecting poles 1*j*,1*k*. To release (or disconnect) poles 1*j*,1*k* from one another, the user urges hand grip 3*j* to axially compress spring 8, so that male locking part 6*j* can be removed from female locking part 6*j*.

The limited axial movement of hand-grip 3*j* is so small that this movement is negligible and not noticeable to the user when ski pole 1*j* is being used conventionally for balance and propulsion.

A spring 8*b*, similar to spring 8 is used in the mounting of second hand grip 3*k* to second pole 1*k* via pin 9*b*, similar to pin 9. Spring 8*b* and pin 9*b* are not required for locking and unlocking the hand grips 3*j*,3*k* together, but they do provide a similar feel, construction and limited movement to the second hand grip 3*k* as is provided for first hand grip 3*j*.

Figures 20A, 20B, 20C:
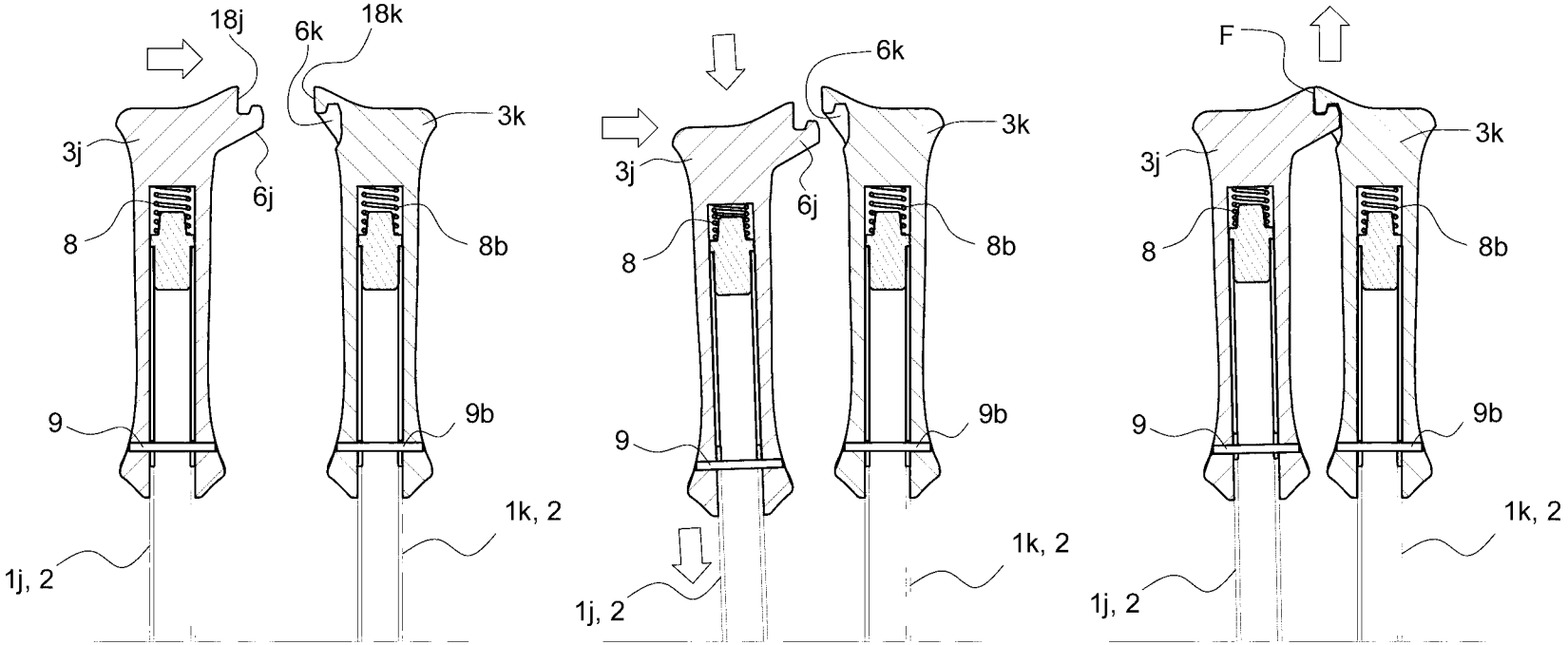
FIGS. 20*a*, 20*b* and 20*c* are cross-sectional schematics of the hand grips of the pair of ski poles as shown in FIG. 9 apart, then as they are being brought together and in engagement.

Also the top of portions of hand grips 3*j*,3*k* each have respective "flat" surfaces 18*j* and 18*k* as shown in FIG. 20*a*. When hand grips 3*j*,3*k* are connected they abut against each other each along an interface F, as shown in FIG. 20*c*. This abutting of flat surfaces 18*j*,18*k* assists in preventing or minimizing the twisting of hand grips 3*j*,3*k* relative to each other when poles 1*j*,1*k* are connected together.

In the third embodiment it should be noted that single basket 4*j* type is used on both poles 1*j*,1*k*. Furthermore the springs 8,8*b* and the pins 9,9*b* are identical for simple assembly of components.

It should be noted that whilst basket 4*j* is of a type have a female thread in its central bore for screw attachment near tip 12, it should be understood that basket 4*j* could be attached to shaft 2 by a conventional snap fit or push fit system.

In the abovementioned first, second and third embodiments the hand grips 3*a*,3*b*,3*c*,3*d*,3*j* and 3*k* are all connected (engaged) to their respective shaft 2 via a pin 9. In order to do this, holes must be drilled or machined into shaft 2. Whilst drilling or machining could be done in a shaft 2 made of aluminium to accommodate a pin 9, such a connection arrangement is not suitable for a shaft 2 made of carbon fibre.

Figure 21:
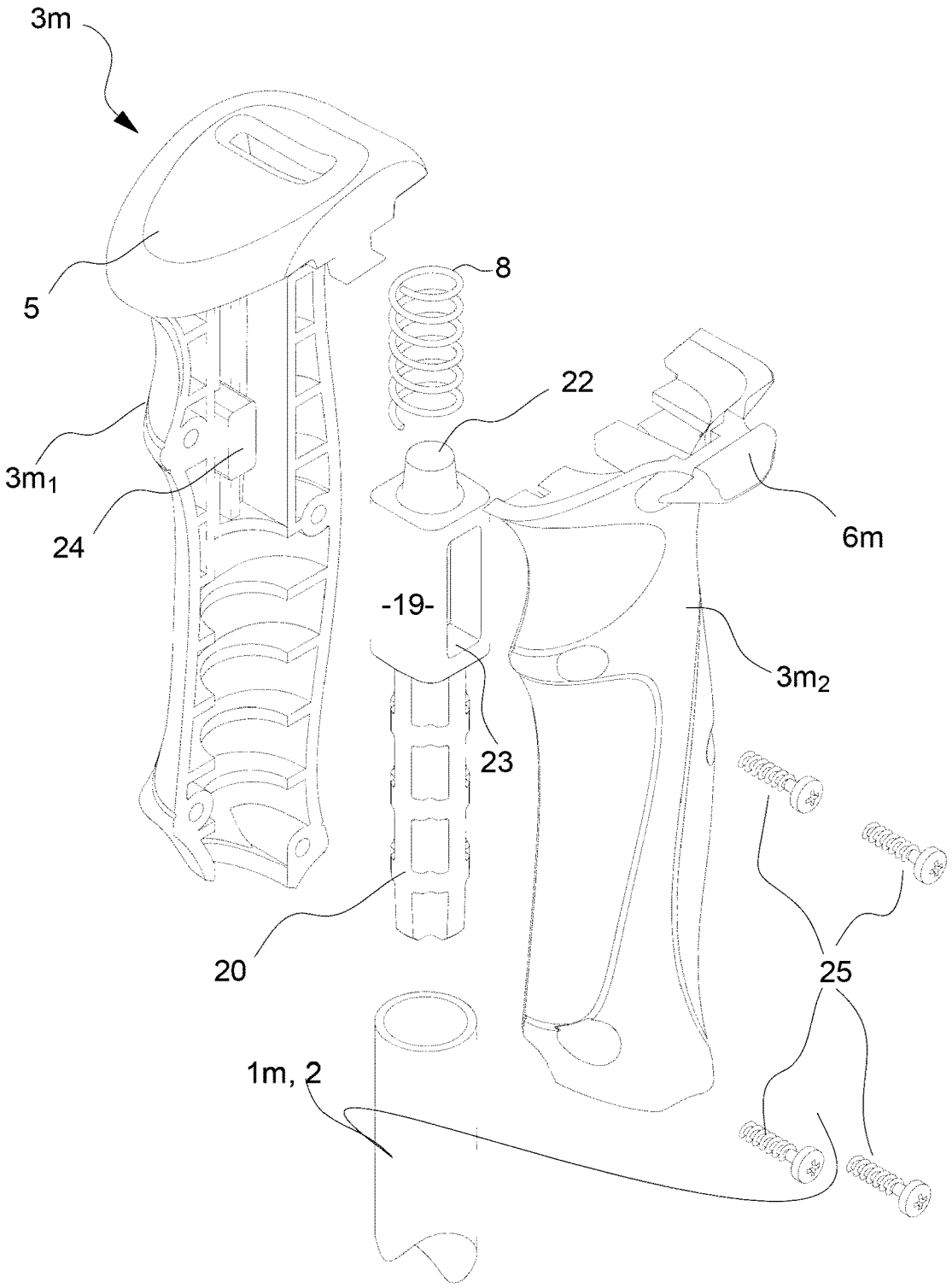
FIG. 21 is an exploded perspective view of the hand-grip of a ski pole in accordance with a fourth embodiment having a projecting male locking part.
Figure 22C:
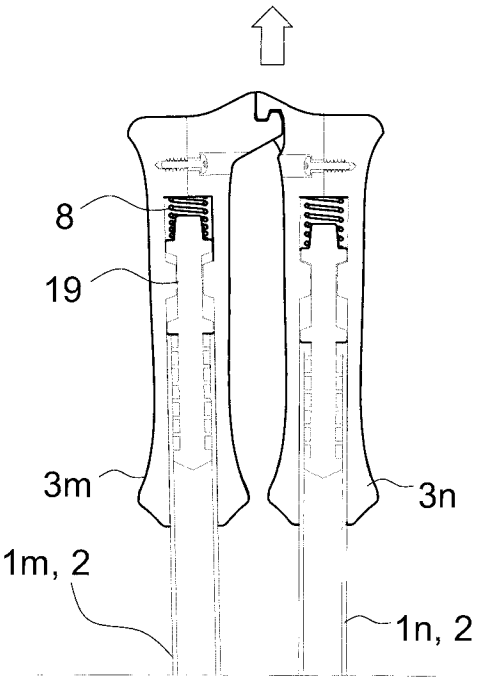
FIGS. 22*a*, 22*b* and 22*c* are cross-sectional schematics of the hand grip of a ski pole shown in FIG. 21 with a hand grip of ski pole having a complementary female locking part, the two ski poles forming a pair of interconnecting ski poles as they are being brought together and in engagement.

FIGS. 21 to 22*c* depict a fourth embodiment of a pair of first and second ski poles 1*m*, 1*n* capable of being interconnected to each other.

In this arrangement, each of the first and second hand grips 3*m*, 3*n* are of a two piece construction connected to a respective shaft 2 via a mount fixture 19.

Both first and second hand-grips 3*m*, 3*n* like those of the earlier embodiments are preferably made of plastic, and each have a pommel 5 at their upper end. On first hand-grip 3*m* below the top of its respective pommel 5 and on one side thereof, is a substantially upward projecting male locking part 6*m*. On second hand-grip 3*n* below the top of its respective pommel 5 and on one side thereof, is a substantially downwardly female/concave (or counter) locking part 6*n* adapted to receive locking part 6*m* of first hand-grip 3*m*. These locking parts 6*m*, 6*n* are similar to the locking parts 6*j*, 6*k* respectively, of the third embodiment.

The two piece hand-grip construction is now described with reference to hand-grip 3*m* having male locking part 6*m* shown in FIG. 21. Hand-grip 3*m* has two halves $\mathbf{3}m_1$ and $\mathbf{3}m_2$ which are connected together via four screws 25. Mount fixture 19 has a first end portion 20 which is glued or mechanically fixed into the end of shaft 2. Mount fixture 19 has a lug 22 at the opposite end to first end portion 20. Lug 22 is adapted to have compression spring 8 mounted thereon. Mount fixture 19 has two keyway pockets 23, one on each side, in which respective posts 24 of grip halves $\mathbf{3}m_1$. $\mathbf{3}m_2$ are located. In FIG. 21, only one keyway pocket 23 is shown (the other hidden) and only post 24 in $\mathbf{3}m_1$ is shown (the other in hand-grip $\mathbf{3}m_2$ is hidden). When hand grip 3*m* is assembled, posts 24 are located inside respective keyway pockets 23, which prevents hand grip 3*m* from rotating relative to shaft 2. As posts 24 are slidably engagable with limited axial travel in the respectively slightly longer keyway pockets 23, a limited travel path of typically less than 5 mm is provided for compression spring 8. The two piece construction for the other hand-grip 3*n* is similar to that of hand-grip 3*m*.

Figure 22B:
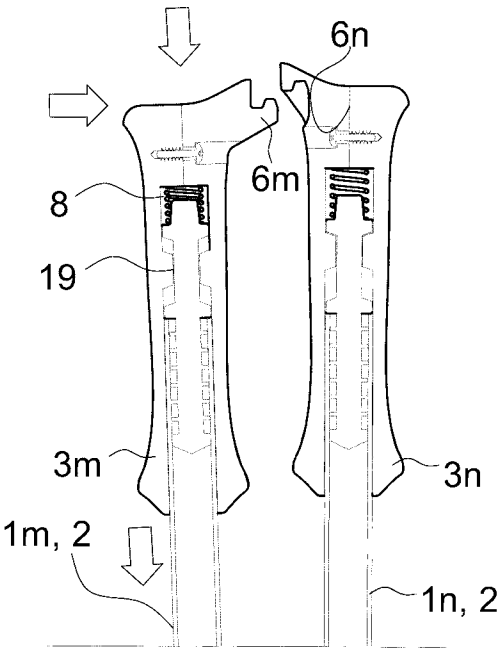
Figure 22A:
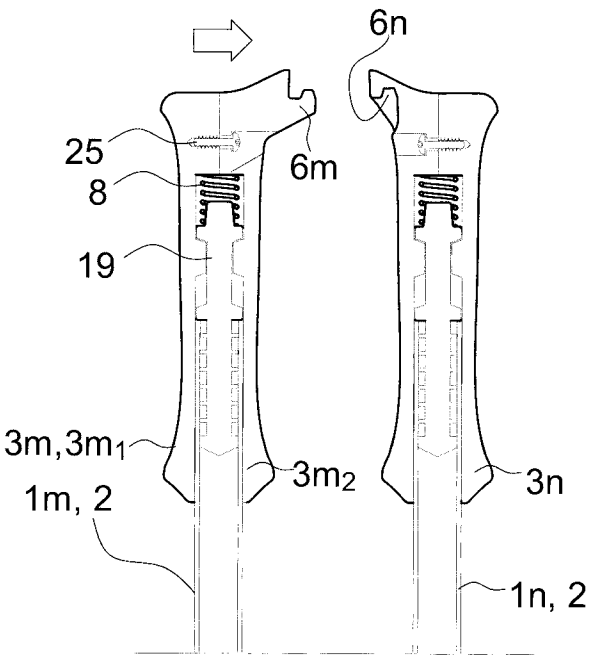

As shown in FIGS. 22*a*-22*c*, the hand grips 3*m*, 3*n* are brought together for connection to each other in a similar fashion to the earlier shown third embodiment. Also like that of the earlier third embodiment, the limited axial movement of hand-grips 3*m*, 3*n* is so small that this movement is negligible when the ski poles are being used conventionally for balance and propulsion.

The advantage of this fourth embodiment over earlier mentioned embodiments, is that it facilitates easier manufacturing where no drilling or machining of shaft 2 is required, making it suitable for shafts made of either carbon fibre or aluminium. Also by splitting hand-grips 3*m*, 3*n* into halves, it is possible to reduce moulding cost and part weight.

The terms "comprising" and "including" (and their grammatical variations) as used herein are used in an inclusive sense and not in the exclusive sense of "consisting only of".

The invention claimed is:

1. A pair of first and second ski poles connectable to each other, said first ski pole having a first shaft with a first hand-grip at an upper end thereof and a first basket near a lower end thereof, said second ski pole having a second shaft with a second hand-grip at an upper end thereof and a second basket near a lower end thereof, said first hand-grip having a locking part thereon for connection to a counter locking part on said second hand-grip, said first hand-grip and second hand-grip each have a pommel at an upper end thereof, and wherein said locking part and counter locking part are formed integrally with the pommel each at a location below a top of the pommel, and said first hand-grip is biasedly mounted to said first shaft by a first spring that allows limited axial movement of said first hand-grip relative to said first shaft, and in use for connection of said first ski pole and said second ski pole said first and second basket engage with each other, and said locking part of said first hand-grip is held in biased engagement via said first spring with said counter locking part of said second hand-grip.

2. The pair of first and second ski poles as claimed in claim 1, wherein said first hand-grip is mechanically restrained to prevent it being detached from said first shaft by the bias force provide by said first spring.

3. The pair of first and second ski poles as claimed in claim 1, wherein said locking part of said first hand-grip is a projecting locking part, and said counter locking part is a female counter locking part for receiving said projecting locking part.

4. The pair of first and second ski poles as claimed in claim 3, wherein a ramp is disposed on said projecting locking part, and a lip is associated with said counter locking part, and said ramp and said lip when brought into engagement with each other to assist said projecting locking part into engagement with said counter locking part.

5. The pair of first and second ski poles as claimed in claim 1, said second hand-grip is biasedly mounted to said second shaft by a second spring that allows limited axial movement of said second hand-grip relative to said second shaft.

6. The pair of first and second ski poles as claimed in claim 1, wherein said first basket of said first pole has male projections engagable with apertures disposed on said second basket.

7. The pair of first and second ski poles as claimed in claim 1, wherein said first basket and said second basket are identical, and said first basket and second basket each has a plurality of engagement units, to allow engagement there between.

8. The pair of first and second ski poles as claimed in claim 6, wherein each engagement unit includes a male projection and an aperture.

9. The pair of first and second ski poles as claimed in claim 1, wherein each of said first hand-grip and second hand-grip are of two piece construction mounted to its respective shaft via mounting fixture engaging the shaft.

10. A pair of first and second ski poles said first ski pole having a first shaft with a first hand-grip at an upper end thereof and a first basket near a lower end, said second ski pole having a second shaft with a second hand-grip at an upper end thereof and a second basket near a lower end, said first and second ski poles are interconnected by engagement of said first and second basket to each other and engagement of said first and second hand-grip to each other, and said first hand-grip and said second hand-grip each have a pommel at an upper end thereof, and wherein a locking part and a counter locking part are formed integrally with each pommel, each at a location below a top of said pommel, and said first hand-grip is biasedly mounted to said first shaft by a first spring that allows limited axial movement of said first hand-grip relative to said first shaft, and wherein engagement of said first and second hand-grip is maintained by a biased force provided by said first spring.

11. The pair of first and second ski poles as claimed in claim 10, wherein said first hand-grip is mechanically restrained to prevent it being detached from said first shaft by the bias force provide by said first spring.

12. The pair of first and second ski poles as claimed in claim 10, wherein a ramp is disposed on said projecting locking part, and a lip is associated with said counter locking part, and said ramp and said lip when brought into engagement with each other to assist said projecting locking part into engagement with said counter locking part.

13. The pair of first and second ski poles as claimed in claim 10, wherein said second hand-grip is mounted to said second shaft via a second spring for limited axial movement relative thereto.

14. The pair of first and second ski poles as claimed in claim 1, wherein each of said first hand-grip and second hand-grip are of two piece construction mounted to its respective shaft via mounting fixture engaging the shaft.

15. A ski pole comprising a shaft with a hand-grip at an upper end thereof, and a basket near a lower end, wherein said hand-grip is biasedly mounted to said shaft via a spring for limited axial movement relative to said shaft, and said hand-grip has a first pommel at an upper end and a locking part integrally formed with and projecting from below a top of said first pommel for connecting to a female counter locking part integrally formed on a second pommel of another associated ski pole, and wherein in use for connection of said ski pole with said another associated ski pole said locking part of said first hand-grip is held in biased engagement via said spring with said female counter locking part of said second pommel of said another associated ski pole.

16. The ski pole as claimed in claim 15, wherein a ramp is disposed on said locking part, and a lip is associated with said female counter locking part on said associated ski pole, and said ramp and said lip when brought into engagement with each other to assist said locking part into engagement with said female counter locking part.

17. The ski pole as claimed in claim 15, wherein said first hand-grip is of a two piece construction mounted to said shaft via a mounting fixture.

18. The ski pole as claimed in claim 17, wherein said spring is mounted on a lug on said mounting fixture.

19. The ski pole as claimed in claim 18, wherein each piece of said hand-grip has a post slidably engagable with a respective keyway pocket in said mounting fixture.

* * * * *